420-582 S5
PTH51 X8 4,545,826

United States Patent [19]
McCunn et al.

[11] Patent Number: 4,545,826
[45] Date of Patent: Oct. 8, 1985

[54] METHOD FOR PRODUCING A WELDABLE AUSTENITIC STAINLESS STEEL IN HEAVY SECTIONS

[75] Inventors: Thomas H. McCunn, Lower Burrell; John P. Ziemianski, Avonmore, both of Pa.

[73] Assignee: Allegheny Ludlum Steel Corporation, Pittsburgh, Pa.

[21] Appl. No.: 625,928

[22] Filed: Jun. 29, 1984

[51] Int. Cl.[4] ..... C21D 7/02; C21D 7/14
[52] U.S. Cl. ..... 148/12 E
[58] Field of Search ..... 148/12 E, 2

[56] References Cited

U.S. PATENT DOCUMENTS

| | | | |
|---|---|---|---|
| 3,065,067 | 11/1962 | Aggen | 75/128 W |
| 3,129,120 | 4/1964 | Smith et al. | 148/38 |
| 3,547,625 | 12/1970 | Bieber et al. | 75/125 |
| 3,716,353 | 2/1973 | Mimino et al. | 75/128 |
| 3,726,668 | 4/1973 | Baumel | 75/125 |
| 4,007,038 | 2/1977 | Deverell | 75/122 |
| 4,078,920 | 3/1978 | Liljas et al. | 75/128 W |
| 4,099,966 | 7/1978 | Chivinsky et al. | 75/125 |
| 4,302,247 | 11/1981 | Abe et al. | 75/128 W |
| 4,371,394 | 2/1983 | Henthorne et al. | 75/128 |
| 4,421,557 | 12/1983 | Rossomme et al. | 75/125 |

OTHER PUBLICATIONS

"Pitting-Resistant Alloys in Highly Concentrated Chloride Media", by Bandy et al., *Corrosion*, vol. 39, No. 6, Jun. 1983, pp. 227-236.

"Properties of Nitrogen-Containing Stainless Alloy Designed for High Resistance of Pitting", by Bandy et al., Corrosion 84, Paper No. 141, Apr. 2-6, 1984.

*Primary Examiner*—Wayland Stallard
*Attorney, Agent, or Firm*—Patrick J. Viccaro

[57] ABSTRACT

A method is provided for producing a nickel-chromium-molybdenum austenitic stainless steel in heavy section sizes and in welded article form substantially free of second phase precipitation from annealing and welding temperatures. The method includes providing nitrogen additions and annealing at temperatures of less than 2100° F., preferably less than 2000° F.

12 Claims, 3 Drawing Figures

METHOD FOR PRODUCING A WELDABLE AUSTENITIC STAINLESS STEEL IN HEAVY SECTIONS

BACKGROUND OF THE INVENTION

This invention relates to a method for producing a corrosion and pitting resistant austenitic stainless steel in heavy section sizes and as welded articles. More particularly, the invention relates to methods of producing such steels having higher nitrogen contents which produce a steel substantially free of second phase precipitation.

It is known that stainless steels have corrosion resistance properties which make them useful in various corrosive environments. Service in highly corrosive media requires steels especially alloyed to withstand the corrosive effects. Chloride pitting and crevice corrosion are severe forms of corrosion which result from metal contact with the chloride ion in corrosive environments such as sea water and certain chemical processing industry media. To be resistant to pitting corrosion, certain austenitic stainless steels have been developed having relatively high chromium and molybdenum levels such as described in Bieber et al U.S. Pat. 3,547,625, issued Dec. 15, 1970. Other examples of austenitic stainless steels containing high levels of molybdenum and chromium are U.S. Pat. Nos. 3,726,668; 3,716,353; and 3,129,120. Such stainless steels with a relatively high molybdenum content sometimes exhibit poor hot workability.

Alloying additions have been used to improve hot workability. U.S. Pat. No. 4,007,038, issued Feb. 8, 1977, describes a high molybdenum-containing alloy with good pitting resistance and good hot workability by virtue of the addition of critical amounts of both calcium and cerium and which has found commercial acceptance. A chromium-nickel-molybdenum austenitic stainless steel having enhanced corrosion resistance and hot workability is disclosed in U.S. Pat. No. 4,421,557, issued Dec. 20, 1983, by additions of the rare earth element lanthanum singly or in combination with nitrogen of 0.12 to 0.5%. Nitrogen is a known austenitizing element which is described in the literature as being useful for reducing the sigma phase and by increasing the time to precipitate the chi phase in a 17% Cr—13% Ni—5% Mo stainless steel.

Such high molybdenum-containing austenitic stainless steels are typically used in thin gauges, such as 0.065 inch (1.65 mm) or less in strip form or as tubing and have excellent corrosion properties. As the gauge, section thickness or shape of the article increases, there is a severe deterioration of corrosion properties due to the development of intermetallic compounds (second phases), such as sigma and chi. Such phases develop upon cooling from a solution annealing temperature or from welding temperatures. Such precipitation of second phases has deterred the commercial selection and of such material in sizes other than thin strip or thin-walled tubing.

Generally, as the presence of the sigma and chi phases are detrimental to corrosion resistance, special heat treatments are necessary to attempt to eliminate the sigma phase. For example, for alloys nominally 25 Ni—20 Cr—6 Mo, described in the above U.S. Pat. No. 4,007,038, such heat treatments require heating in excess of 2000° F. (1093° C.) or more followed by a rapid cooling. As a practical matter for commercial production, such alloys are generally heated in excess of 2150° F. (1177° C.). A practical problem of such requirements is that such practices restrict the useful equipment as well as, restrict the size or shape of the articles made from such alloys. For example, some applications often require heavy gauge support products, such as plate, as well as light gauge weldable tubing, such as condenser tubing After assembly by welding, the size and shape of the assembled equipment may prevent use of a final heat treatment or if capable of a heat treatment, the size and shape may severely limit the ability to cool rapidly from the heat treatment or weld temperature. The cooling rates of heavier sections are slower than those of thinner sections when water quenched or air cooled.

What is needed is a method of producing an austenitic stainless steel alloy in heavier plate sections which are weldable and which has the same corrosion resistance as thin strip. It is also an object to produce such stainless steel articles without the need for extraordinary heat treating and cooling steps. It is a further object to modify the kinetics of the precipitation of the sigma phase in the Cr—Ni—Mo alloys in order to reduce the amount of second phase precipitated during cooling from the annealing and welding temperatures.

SUMMARY OF THE INVENTION

In accordance with the present invention, a method is provided for producing a chromium-nickel-molybdenum austenitic stainless steel article in heavy sections greater than 0.065 inch (1.65 mm). The steel comprises by weight, 20 to 40% nickel, 14 to 21% chromium, 6 to 12% molybdenum, 0.15 to 0.30% nitrogen and the remainder substantially all iron. The method comprises melting, casting, hot rolling and cold rolling the steel to final gauge greater than 0.065 inch, fully annealing the final gauge steel at temperatures greater than 1900° F. (1038° C.) and less than about 2100° F. (1149° C.) to produce a steel substantially free of second phase precipitation. The method of producing the steel with the higher nitrogen content results in suppressing the sigma phase solvus temperature, retarding the onset of precipitation and increasing the critical crevice corrosion temperature. The method may include welding the heavy section steel to produce welded articles which are substantially free of second phase precipitation and welding including the use of nitrogen-bearing weld filler metal.

DETAILED DESCRIPTION OF THE PREFERRED EMBODIMENTS

Figure 1:
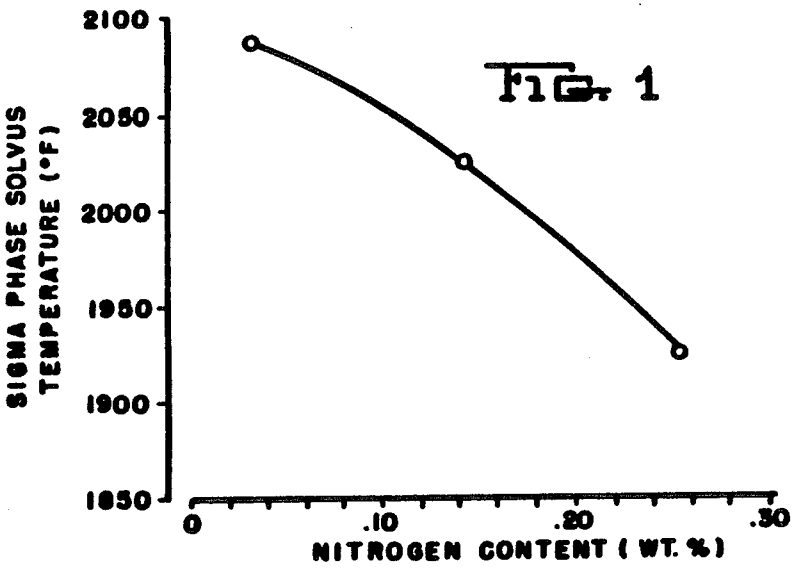
FIG. 1 is a graph of sigma phase solvus temperature as a function of nitrogen content.

Broadly, the method of the present invention relates to producing Ni—Cr—Mo austenitic stainless steels in heavy sections and welded article forms which are free of second phase precipitates without special heat treatment.

As for the composition of the steel, the chromium contributes to the oxidation and general corrosion resistance of the steel and may be present from 14 to 21% by weight. Preferably, the chromium content may range from 18 to 21%. The chromium also contributes to increasing the solubility for nitrogen in the steel. The steel may contain 6 to 12% molybdenum and, preferably, 6 to 8% molybdenum which contributes to resistance to pitting and crevice corrosion by the chloride ion. The nickel is primarily an austenitizing element which also contributes and enhances the impact strength and toughness of the steel. Nickel additions also improve the stress corrosion resistance of the steel. The nickel may range from 20 to 40% and, preferably 20 to 30% by weight. In combination, the high chromium and the molybdenum provide good resistance to pitting and crevice attack by chloride ions. The high nickel and the molybdenum provide good resistance to stress corrosion cracking and improve general corrosion resistance, particularly resistance by reducing acids. The alloy can contain up to 2% manganese which tends to increase the alloy's solubility of nitrogen. The alloy can also contain up to 0.04% carbon, preferably 0.03% maximum and residual levels of phosphorus, silicon, aluminum, other steelmaking impurities and the balance iron.

An important element in the composition of the steel is the presence of relatively high levels of nitrogen. Not only does the addition of nitrogen increase the strength and enhance the crevice corrosion resistance of the steel, it has been found that nitrogen additions delay the formation of sigma phase which occurs on slower cooling of the steel such as when it is in thick section sizes. The nitrogen retards the rate of sigma phase precipitation, i.e., the onset of precipitation to permit production and welding of thick section sizes greater than 0.065 inch and up to 1.50 inch (28.1 mm) and particularly up to 0.75 inch (19.1 mm), without any detrimental effects on corrosion resistance or hot workability. Nitrogen is present from about 0.15% up to its solubility limit which is dependent upon the exact composition and temperature of the steel. For the ranges of nickel, chromium and molybdenum described herein, the solubility limit of nitrogen may be 0.50% or more. Preferably, the nitrogen is present from about 0.15 to 0.30% and, more preferably, from 0.18 to 0.25%.

In order to more completely understand the present invention, the following examples are presented.

EXAMPLE I

Laboratory heats of the following compositions were melted and processed to 0.065 inch (1.65 mm) thick strip and 0.5 inch (12.7 mm) thick plate.

TABLE I

| Heat No. | C | Mn | P | S | Si | Cr | Ni | Mo | Al | Cu | N | O | Co | Ce |
|---|---|---|---|---|---|---|---|---|---|---|---|---|---|---|
| RV-8624 | .022 | .39 | .020 | .002 | .40 | 20.12 | 24.50 | 6.45 | .063 | .16 | .023 | .0048 | .0083 | .04 |
| RV-8782 | .026 | 1.60 | .025 | .002 | .35 | 20.66 | 23.90 | 6.29 | .028 | .15 | .032 | .0056 | .0008 | .0041 |
| RV-8783 | .024 | 1.64 | .025 | .002 | .39 | 20.60 | 24.53 | 6.40 | .046 | .15 | .14 | .0005 | .0008 | .022 |
| RV-8784 | .025 | 1.58 | .025 | .003 | .43 | 20.57 | 24.55 | 6.42 | .021 | .14 | .25 | .0005 | .0013 | .015 |

Each of the compositions was melted and cast into ingot form. Fifty-pound (22.7 Kg) ingots of Heat Nos. RV-8782, 8783, and 8784 were surface ground, heated to 2250° F. (1232° C.), squared and spread to 6 inches (152 mm) wide. The sheet bar was surface ground, reheated to 2250° F. and rolled to 0.5 inch thick. The plate was hot sheared and the part designated for 0.5 inch plate was flattened on a press. The remainder of the plate was reheated to 2250° F. and rolled to 0.15 inch (3.8 mm) thick band. Edges of both the plate and band were good. In order to evaluate the kinetics of second phase precipitation, particularly sigma phase precipitation, the solvus temperature of certain compositions wer mined. Hot rolled band samples of Heat Nos. 1 and RV-8784 were heat treated at 1650° F. (89 8 hours to form sigma phase and then further hea treated for 8 hours at 1900° F. (1038° C.) to 2150° F. (1177° C.) and water quenched. Metallographic examination showed the sigma phase solvus temperature of the heats as set forth in Table II.

TABLE II

| Heat No. | N (Wt. %) | Sigma Phase Solvus Temperature °F. (°C.) |
|---|---|---|
| RV-8783 | .14 | 2000–2050 (1093–1121) |
| RV-8784 | .25 | 1900–1950 (1038–1066) |

It is known that the sigma phase solvus temperature of compositions similar to Heat Nos. RV-8624 and RV-8782 with less than 0.10% nitrogen is greater than 2050° F. (1121° C.) and is between 2075°–2100° F. (1135°–1149° C.). A comparision clearly shows that the heats containing nitrogen of 0.14% and 0.25% exhibit a decrease in the sigma phase solvus temperature. FIG. 1 graphically illustrates the effect of nitrogen on the average solvus temperature. As nitrogen increases, the solvus temperature is decreased below 2000° F. Nitrogen additions slow or retard the rate of sigma phase precipitation, i.e., the onset of precipitation below 2000° F. Such a reduction in the second phase precipitation permits use of annealing temperatures lower than the present 2150° F. or higher necessary in commercial processes for producing alloys having compositions similar to Heat Nos. RV-8624 and RV-8782. The ability to use lower annealing temperatures below 2100° F. and preferably below 2000° F. may provide steel having smaller grain size. Lower annealing temperatures particularly improve the economics of production of such alloys by permitting use of conventional annealing equipment such as that used for the 300 Series stainless steels.

EXAMPLE II

Corrosion samples were prepared to determine the critical crevice corrosion temperature (CCCT) for the heats. The CCCT is the temperature at which crevice corrosion becomes apparent after a 72-hour test in 10% $FeCl_3$ in accordance with ASTM Procedure G-48-Practice B. Higher CCCT demonstrates improved resistance to crevice corrosion in chloride-containing environments. For purposes of the test, the CCCT is taken to be that temperature at which weight loss exceeds 0.0001 gms/cm$^2$.

The 0.5 inch thick plate of Heat Nos. RV-8624 and RV-8782 was annealed at 2200° F. (1204° C.) for 0.5 hours and fan cooled. The plate of Heat Nos. RV-8783 and RV-8784 was annealed at 2100° F. (1149° C.) and fan cooled. The plates were sawed in half lengthwise and machined all over. One edge was beveled 37.5° with a 1/16 inch (1.6 mm) land for welding. The plate of Heat No. RV-8624 was GTA welded using 0.065-inch thick sheared strips having substantially the same composition as base plate metal. The other three heats were welded in a similar manner, except for the use of nickel alloy 625 filler metal. The plates were welded from one side. Corrosion specimens from the base metal and weld were machined so that the weld was flush with the base metal. The weld was transverse to the long dimension. After machining, the corrosion specimens were about 0.68 inch (17 mm) wide by 1.9 inch (48 mm) long by 0.37 inch (9.4 mm) thick.

The hot rolled band of Heat Nos. RV-8782, RV-8783 and RV-8784 was annealed at 2200° F. (1204° C.), cold rolled to 0.065 inch (1.6 mm) thick and annealed at 2200° F., followed by a fan cool. The strip was sheared in half and TIG welded back together without filler metal. Corrosion specimens, 1 inch by 2 inch (25 by 51 mm), were prepared from the base metal and weld with machined edges and surface grinding of the flat faces. The weld was in the 2-inch dimension. Tests in accordance with ASTM Procedure G-48 were conducted at various temperatures to determine critical crevice corrosion temperatures shown in Table III.

TABLE III

| Heat No. | Wt. % N | CCCT - °F. (°C.) Strip Base | Strip Welded | Plate Base | Plate Welded |
|---|---|---|---|---|---|
| RV-8624 & RV-8782 | .023 & .032 | 80 (27) | 78 (26) | 80 (27) | 78 (26) |
| RV-8783 | .14 | 91 (33) | 86 (30) | 90 (32) | 90 (32) |
| RV-8784 | .25 | 100 (38) | 95 (35) | 104 (40) | 104 (40) |

The data in Table III clearly show that the addition of nitrogen improves the crevice corrosion resistance of both the base metal and the autogenous welded specimens as compared to the low nitrogen-containing heats. The welded strip specimens of the higher nitrogen heats have somewhat poorer crevice corrosion resistance than the base metal, but exceed the base metal CCCT of low nitrogen-containing heats. The welded plate specimens with the nickel-base filler metal (Alloy 625) have similar crevice corrosion resistance as the base metal specimens. The crevice corrosion resistance of Heat RV-8784 is higher for plate specimens than strip specimens and may be a result of scatter in the data. Such better corrosion properties for welded plate are unexpected. Furthermore, as the low nitrogen heats RV-8624 and RV-8782 contain about 0.03% nitrogen nominally, the increase in crevice corrosion critical temperature (CCCT) appears to be about 10° F. (5.6° C.) per 0.1% by weight nitrogen increase.

The data exhibit that additions of nitrogen improve the crevice corrosion resistance of base metal. Furthermore, autogenously welded strip and plate had similar crevice corrosion resistance as the base metal. The plate welded with nickel-base filler material also had similar crevice corrosion resistance as the base metal. The corrosion resistance of autogenously welded strip of heats containing increased nitrogen content was somewhat poorer than the base metal, possibly as a result of loss of nitrogen during welding. Both strip and plate of Heats RV-8624 and RV-8782 were heat treated such that the base metal had a discontinuous, fine precipitate of sigma phase in the grain boundaries. The increasing additions decrease the amount of grain boundary precipitate in the base metal and the heat-affected zone (HAZ). Heats RV-8783 and RV-8784 had no precipitate or very light precipitate, respectively, in the base metal and HAZ of strip and plate.

EXAMPLE III

The critical crevice corrosion temperature (CCCT) for strip was also determined for two groups of specimens having different heat treatment. Strip at 0.065 inch thick was annealed at 2200° F., 2050° F. and 2000° F. (1204, 1121 and 1093° C.) for Heat Nos. RV-8782, RV-8783 and RV-8784, respectively, and then water quenched. The CCCT for the two groups of specimens are as shown in Table IV.

TABLE IV

| Heat No. | Heat Treatment | CCCT, °F. (°C.) Base | CCCT, °F. (°C.) Welded | Heat Treatment | CCCT, °F. (°C.) Base | CCCT, °F. (°C.) Welded |
|---|---|---|---|---|---|---|
| RV-8782 | 2200F (1204C)-FC | 78 (26) | 76 (24) | 2200F (1204C)-WQ | 96 (36) | 85 (29) |
| RV-8783 | 2200F (1204C)-FC | 91 (33) | 84 (29) | 2050F (1121C)-WQ | 108 (42) | 93 (34) |
| RV-8784 | 2200F (1204C)-FC | 100 (38) | 94 (34) | 2000F (1093C)-WQ | 108 (42) | 96 (36) |

FC means Fan Cooled.
WQ means Water Quenched.

The critical crevice corrosion temperature of the base metal specimens increase substantially with a water quench compared to a fan cool. The base metal of Heat No. RV-8782 exhibited a fine, discontinuous precipitate of sigma phase after the 2200° F. fan cool anneal, while the other two heats exhibited no sigma phase. None of the heats showed sigma phase in the base metal after heat treatment followed by a water quench. The critical crevice corrosion temperature of the welded specimens of Heat Nos. RV-8782 and RV-8783 also increased substantially, while that of Heat No. RV-8784 remained nearly the same. All heats showed sigma phase in the weld. Heat No. RV-8782 exhibited sigma phase in the HAZ as a fine, discontinuous precipitate in the grain boundaries. No sigma phase was observed in the HAZ of Heat Nos. RV-8783 and RV-8784. The data of Heat No. RV-8784 show that high nitrogen-containing heats can be annealed at 2000° F./WQ and exhibit good CCCT values, which would be adversely affected if the alloy was not substantially free of sigma phase following the anneal. The data from specimens having a water quench after annealing suggest that the cooling rate has a substantial influence on the corrosion resistance. The decrease in the CCCT in the weld zone is attributed to a greater degree of segregation, i.e., coring of elements such as Cr, Mo and Ni typical of cast (weld) structures.

Figure 2:
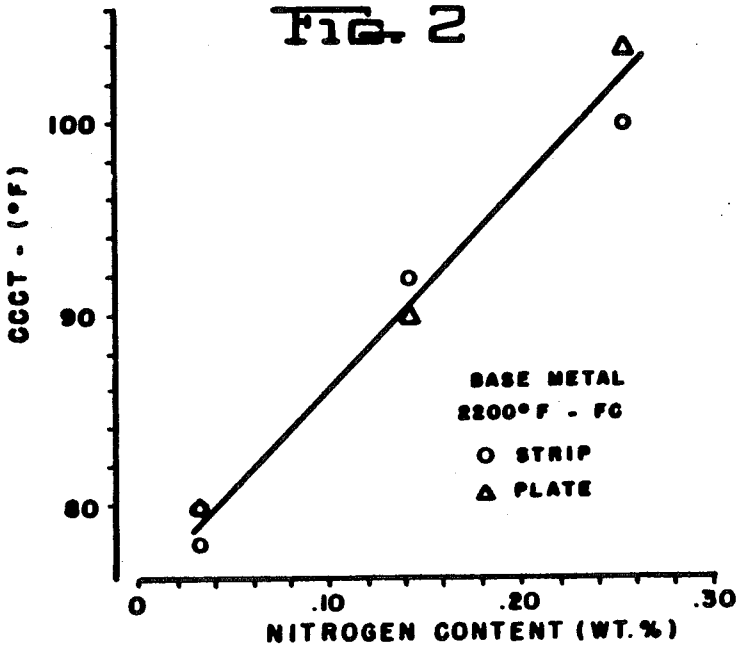
FIG. 2 is a graph of critical crevice corrosion temperature versus nitrogen content.

FIG. 2 graphically illustrates the effects of nitrogen on CCCT for both plate and strip heats. The CCCT is directly proportional to nitrogen content and improves for increasing nitrogen levels. Also, the Figure demonstrates that thicker material can be made with no effective deterioration in CCCT. Furthermore, lower solution annealing temperatures can be used without compromising CCCT when rapidly cooled such as by water quenching after annealing.

EXAMPLE IV

Bend tests were conducted on weld specimens of the thick plate of Example II. Bend specimens were made approximately 0.375 inch (9.5 mm) wide, and were sawed to contain the weld. The 180° side bend tests were conducted by bending the specimens with the weld located at the apex of the bend over a pin 0.75 inch (19.1 mm) diameter, such that the ratio of the pin radius to the plate thickness equals 1.0. All specimens exhibited no cracks, as shown in Table V, after a 1T bend, which demonstrates excellent ductility of base metal, weld metal and heat affected zone.

TABLE V

| Side Bends of Welded Plate | | | |
|---|---|---|---|
| Heat No. | Filler Metal | Radius of Pin/Thickness | 180 Degree Bend |
| RV-8624 | Matching Composition | 1 | Pass |
| | | 1 | Pass |
| RV-8782 | Alloy 625 | 1 | Pass |
| | | 1 | Pass |
| RV-8783 | Alloy 625 | 1 | Pass |
| | | 1 | Pass |
| RV-8784 | Alloy 625 | 1 | Pass |
| | | 1 | Pass |

The results of the bend test demonstrate that the increased nitrogen content has not adversely affected the fabricability of the material.

EXAMPLE V

Figure 3:
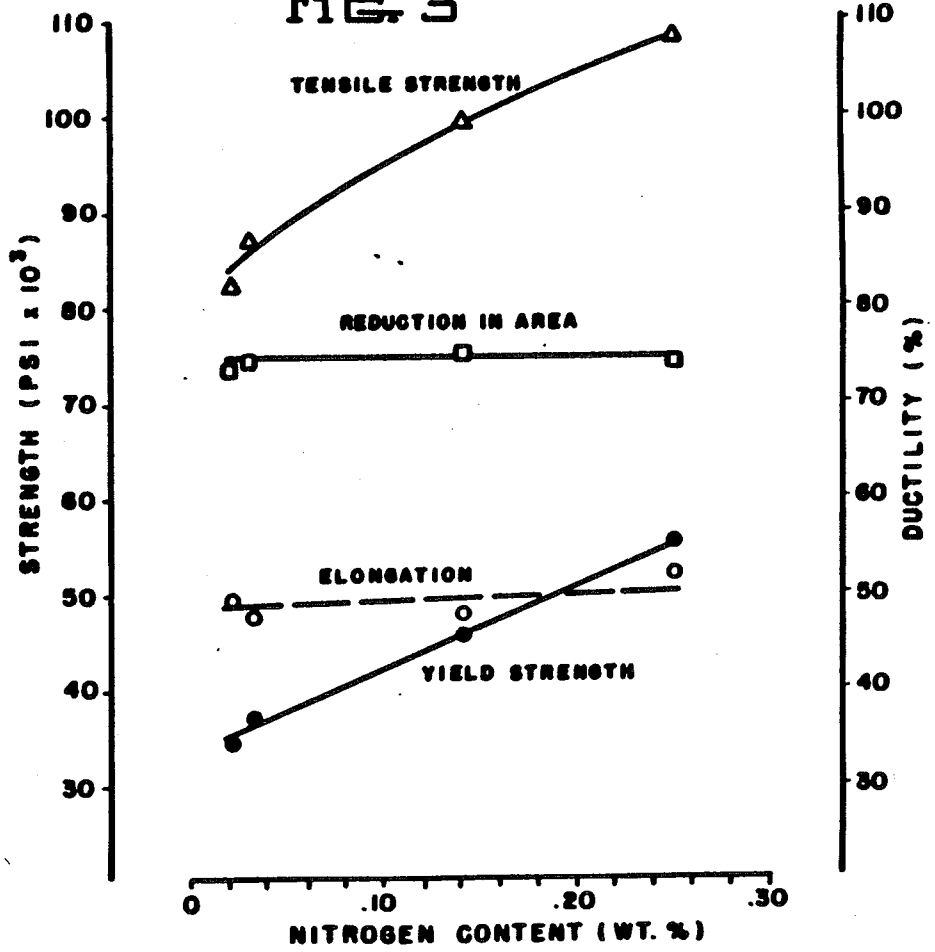
FIG. 3 is a graph of room temperature mechanical properties as a function of nitrogen content.

Room temperature mechanical properties of the plate of Example II are shown in Table VI. Generally, the results show an increase in strength and hardness as a result of the addition of nitrogen, with substantially no loss or change in the elongation or ductility of the material as evidenced by tensile elongation and reduction in area. FIG. 3 graphically illustrates the effect of nitrogen on longitudinal tensile and yield strengths, elongation and reduction in area as a plot of the average values from Table VI.

TABLE VI

| Longitudinal Tensile Properties of Plate | | | | | | |
|---|---|---|---|---|---|---|
| Heat No. | N Wt. % | Hardness $R_B$ | 0.2% Yield Strength Ksi (MPa) | Tensile Strength Ksi (MPa) | Elong. in 1 in. (25.4 mm), % | Reduction in Area % |
| RV-8624 | .023 | 63 | 34.7 (239) | 82.1 (566) | 50.0 | 76.6 |
| | | | 34.1 (235) | 82.8 (571) | 49.0 | 71.1 |
| RV-8782 | .032 | 68 | 37.6 (259) | 86.8 (598) | 48.0 | 75.6 |
| | | | 37.3 (257) | 87.1 (600) | 47.5 | 73.6 |
| RV-8783 | .14 | 76 | 47.3 (326) | 99.5 (686) | 48.5 | 75.6 |
| | | | 44.3 (305) | 99.0 (682) | 47.5 | 75.6 |
| RV-8784 | .25 | 82 | 53.2 (367) | 108.5 (748) | 53.0 | 73.6 |
| | | | 57.5 (396) | 107.7 (742) | 51.0 | 75.1 |

The method of the present invention provides a material which is extremely stable austenitic stainless steel which does not transform even under extensive forming as judged by low magnetic permeability, even after heavy deformation. The nitrogen addition allows production of plate material with the same level of corrosion resistance as the strip product of less than 0.065 inch thickness. The nitrogen also contributes to the chloride pitting and crevice corrosion resistance of the alloy, as well as increasing the strength without compromising ductility. The method of the present invention permits production of the austenitic stainless steel article in heavy sections, such as plate, which is substantially free of second phase precipitation following annealing of the final gauge at temperatures of less than 2100° F. and, as low as, less than 2000° F. Although several embodiments of the present invention have been shown and described, it will be apparent to those skilled in the art that modifications may be made therein without departing from the scope of the present invention.

What is claimed is:

1. A method for producing an austenitic stainless steel article in heavy sections, said steel comprises, by weight, 20 to 40% nickel, 14 to 21% chromium, 6 to 12% molybdenum, 0.15 to 0.30% nitrogen, and the remainder substantially all iron, the method comprising melting, casting, hot rolling and cold rolling the steel to final gauge greater than 0.065 inch, fully annealing the final gauge steel at temperatures of greater than 1900° F. and less than about 2100° F. to produce a steel substantially free of second phase precipitation.

2. The method of claim 1, wherein the steel has nitrogen ranging from 0.18 to 0.25%.

3. The method of claim 1 wherein the steel includes up to 2% manganese.

4. The method of claim 1, wherein the steel includes 20 to 30% nickel, 18 to 21% chromium, 6 to 8% molybdenum, and 0.18 to 0.25% nitrogen.

5. The method of claim 1, wherein the steel comprises 20 to 40% nickel, 14 to 21% chromium, 6 to 12% molybdenum, 0.15 to 0.30% nitrogen, up to 2% manganese, and the remainder substantially all iron.

6. The method of claim 1, wherein the final gauge ranges up to 1.5 inches.

7. The method of claim 1, wherein the steel is annealed at less than 2000° F.

8. The method of claim 1, further including welding the steel to produce a welded article substantially free of second phase precipitation.

9. The method of claim 8, wherein welding includes using a nickel-base weld filler metal.

10. An article made by the method of claim 1 having a second phase solvus temperature reduced to below 2000° F. and a critical crevice corrosion temperature of about 85° F. or more.

11. A welded article made by the method of claim 8 and being substantially free of second phase precipitation.

12. A method for producing an austenitic stainless steel article, said steel comprises, by weight, 20 to 40% nickel, 14 to 21% chromium, 6 to 12% molybdenum, 0.15 to 0.30% nitrogen, up to 2% manganese, and the remainder substantially all iron, the method comprising melting, casting, hot rolling and cold rolling the steel to final gauge greater than 0.065 inch, annealing the final gauge steel at temperatures of between about 1900 and 2000° F. to produce a steel substantially free of second phase precipitation.

• • • • •

UNITED STATES PATENT OFFICE
CERTIFICATE OF CORRECTION

Patent No. 4,545,826 Dated October 8, 1985

Inventor(s) T.J. McCunn, J.P. Ziemianski, and I.A. Franson

It is certified that error appears in the above-identified patent and that said Letters Patent are hereby corrected as shown below:

Title page:

Line [75] should be corrected by adding Ivan A. Franson as a co-inventor and should read as follows:

-- [75] Inventors: Thomas H. McCunn, Lower Burrell; John P. Ziemianski, Avonmore; and Ivan A. Franson, Gibsonia, all of Pa. --

Signed and Sealed this

Seventeenth Day of December 1985

[SEAL]

Attest:

DONALD J. QUIGG

Attesting Officer

Commissioner of Patents and Trademarks